US012599209B2

(12) United States Patent
Huang et al.

(10) Patent No.: US 12,599,209 B2
(45) Date of Patent: Apr. 14, 2026

(54) CARD FIXATION ASSEMBLY FOR CARD HOLDER AND CARD HOLDER

(71) Applicant: DongGuan Casekey Industry Co., Ltd, Dongguan (CN)

(72) Inventors: Haiyan Huang, Dongguan (CN); Youguo Zhou, Dongguan (CN)

(73) Assignee: DongGuan Casekey Industry Co., Ltd, Dongguan (CN)

( * ) Notice: Subject to any disclaimer, the term of this patent is extended or adjusted under 35 U.S.C. 154(b) by 159 days.

(21) Appl. No.: 18/451,848

(22) Filed: Aug. 18, 2023

(65) Prior Publication Data

US 2024/0277122 A1 Aug. 22, 2024

(30) Foreign Application Priority Data

Feb. 16, 2023 (CN) ..... 202320230872.1
Mar. 6, 2023 (CN) ..... 202320399729.5

(51) Int. Cl.
*A45C 11/18* (2006.01)

(52) U.S. Cl.
CPC ..... *A45C 11/182* (2013.01)

(58) Field of Classification Search
CPC ..... A45C 11/182
USPC ..... 150/147
See application file for complete search history.

(56) References Cited

U.S. PATENT DOCUMENTS

| | | | | |
|---|---|---|---|---|
| 9,010,758 | B1 | 4/2015 | Malmloff | |
| 10,284,246 | B2 | 5/2019 | Li et al. | |
| 10,344,091 | B2 * | 7/2019 | Koide | A61P 37/06 |
| 10,763,907 | B2 | 9/2020 | Zuo et al. | |
| 11,340,086 | B2 * | 5/2022 | Jang | G01C 21/3697 |
| 2022/0019316 | A1 * | 1/2022 | Sugita | G06F 3/0446 |

FOREIGN PATENT DOCUMENTS

| | | | |
|---|---|---|---|
| CN | 211054775 | U | 7/2020 |
| WO | 2010137975 | A2 | 12/2010 |

* cited by examiner

*Primary Examiner* — Sue A Weaver

(57) ABSTRACT

A card fixation assembly for a card holder, including: a main body, a first elastic arm, a second elastic arm, a first clamping end, and a second clamping end. A first elastic arm start end and a second elastic arm start end are connected to the main body; a first elastic arm tail end is connected to the first clamping end; and a second elastic arm tail end is connected to the second clamping end. The first clamping end includes a first protrusion; the second clamping end includes a second protrusion; and the first second protrusions are configured to limit displacement of a card, such that the card is not separated from the card fixation assembly naturally. The card can be easily and conveniently stored and taken, and the displacement of the card is still firmly restricted after long-time use.

9 Claims, 10 Drawing Sheets

CARD FIXATION ASSEMBLY FOR CARD HOLDER AND CARD HOLDER

TECHNICAL FIELD

The present disclosure relates to the technical field of daily supplies, and in particular, to a card fixation assembly for a card holder and a card holder.

BACKGROUND

In daily life, it is often necessary to use various cards, such as bank cards, credit cards and ID cards. Cards are currently mainly placed in ordinary flexible plastic or leather card holders for storage. When a certain card needs to be used, a card owner needs to search for the card from cards in the card case or card holder. In addition, the plastic or leather card case cannot resist an external extrusion force due to the softness thereof, which may easily cause the cards to be bent, deformed or even damaged in the card holder.

Various card holders are disclosed in the related art. Friction elements are generally used to fix the cards from sides of the cards, such that the cards are fixed in the card holder. For example, PCT International Patent Application No. PCT/NL2010/050314 discloses a card storer. This patent discloses the feature of fixing both sides of the cards with fiber mats and elastic elements. However, after the elastic elements and the fiber mats are used for a long time, the elastic force of the elastic elements attenuates, and the elasticity of the fiber mats cannot fully recover to its original state. Therefore, the elastic elements have reduced frictional force on fixation of the cards, and the cards may easily slide out of the card holder under the impact of an external force.

For another example, Chinese Patent CN211054775U discloses a multifunctional card holder. This patent discloses the feature of fixing both sides of the cards with soft damping pads and rubber anti-slip strips thereon. However, after the damping pads are used for a long time, the frictional damage of the anti-slip strips on the damping pads is also irreversible, which still causes the cards to fail to be fixed in the card holder and easily slip off.

SUMMARY OF PRESENT INVENTION

The technical problem to be solved by embodiments of the present disclosure is to provide a new card fixation assembly for a card holder so as to resolve various deficiencies in the existing card storer for fixing cards. According to the present disclosure, cards can not only be easily stored and taken in or out of the card holder, but also work smoothly after long-time use.

To solve the technical problems above, embodiments of the present disclosure provide a card fixation assembly for a card holder, including: a main body, a first elastic arm, a second elastic arm, a first clamping end, and a second clamping end, where a first elastic arm start end and a second elastic arm start end are connected to the main body; a first elastic arm tail end is connected to the first clamping end; a second elastic arm tail end is connected to the second clamping end;

the first clamping end includes a first protrusion; the second clamping end includes a second protrusion; the first protrusion and the second protrusion are configured to limit displacement of a card; the first protrusion includes a first concave surface and a first convex surface; the first concave surface is matched with an arc angle of the card; the first convex surface is adjacent to the first concave surface, and is located at a tail end of the first protrusion; the second protrusion includes a second concave surface and a second convex surface; the second concave surface is matched with the arc angle of the card; and the second convex surface is adjacent to the second concave surface, and is located at a tail end of the second protrusion.

Preferably, the first clamping end further includes a first clamping body; the first clamping body and the first elastic arm are integrally formed; and a tail end of the first clamping body is thinner than a junction between the first clamping body and the first elastic arm.

Preferably, the second clamping end further includes a second clamping body; the second clamping body and the second elastic arm are integrally formed; and a tail end of the second clamping body is thinner than a junction between the second clamping body and the second elastic arm.

Preferably, at least one of the first elastic arm and the second elastic arm is provided with a groove, and the groove is configured to place an anti-slip pad.

Preferably, a distance between the first elastic arm start end and the second elastic arm start end is greater than a distance between the first elastic arm tail end and the second elastic arm tail end.

Preferably, the first elastic arm, the second elastic arm, and the main body are integrally formed.

Preferably, the main body includes at least one fixed shaft.

Preferably, the main body further includes at least one notch.

The utility model further provides a card holder, including: a housing, a card pusher, and the card fixation assembly for a card holder, where the card fixation assembly is mounted in the housing, and the card pusher is mounted on the main body of the card fixation assembly.

The embodiments of the present disclosure have the following beneficial effects:

(1) According to the present disclosure, the first concave surface and the second concave surface are matched with the arc angles of the card, such that the card is fixed in the card holder. The first elastic arm and the second elastic arm provide an elastic force, and the first clamping end and the second clamping end provide the concave surfaces and the convex surfaces, such that the card is easily and conveniently stored and taken.

BRIEF DESCRIPTION OF THE DRAWINGS

To describe the technical solutions in the embodiments of the present disclosure or in the prior art more clearly, the following briefly describes the accompanying drawings required for describing the embodiments or the prior art. Apparently, the accompanying drawings in the following description show merely some embodiments of the present disclosure, and those skilled in the art may still derive other drawings from these accompanying drawings without creative efforts.

1—Card holder, 2—Card, 10—First elastic arm, 11—First elastic arm start end, 12—First elastic arm tail end, 13—Groove, 20—Second elastic arm, 21—Second elastic arm start end, 22—Second elastic arm tail end, 30—First clamping end, 31—First protrusion, 311—First concave surface, 312—First convex surface, 32—First clamping body, 40—Second clamping end, 41—Second protrusion, 411—Second concave surface, 412—Second convex surface, 42—Second clamping body, 43—Partition, 50—Main body, 51—Fixed shaft, 52—Notch, 100—Card fixation assembly, 200—Housing, 201—arc of the card, and 300—Card pusher.

DETAILED DESCRIPTION OF THE EMBODIMENTS

The technical solutions of the embodiments of the present disclosure are clearly and completely described below with reference to the drawings in the embodiments of the present disclosure. Apparently, the described embodiments are merely a part rather than all of the embodiments of the present disclosure. All other embodiments obtained by those skilled in the art based on the embodiments of the present disclosure without creative efforts shall fall within the protection scope of the present disclosure.

Embodiment 1

Figure 1:
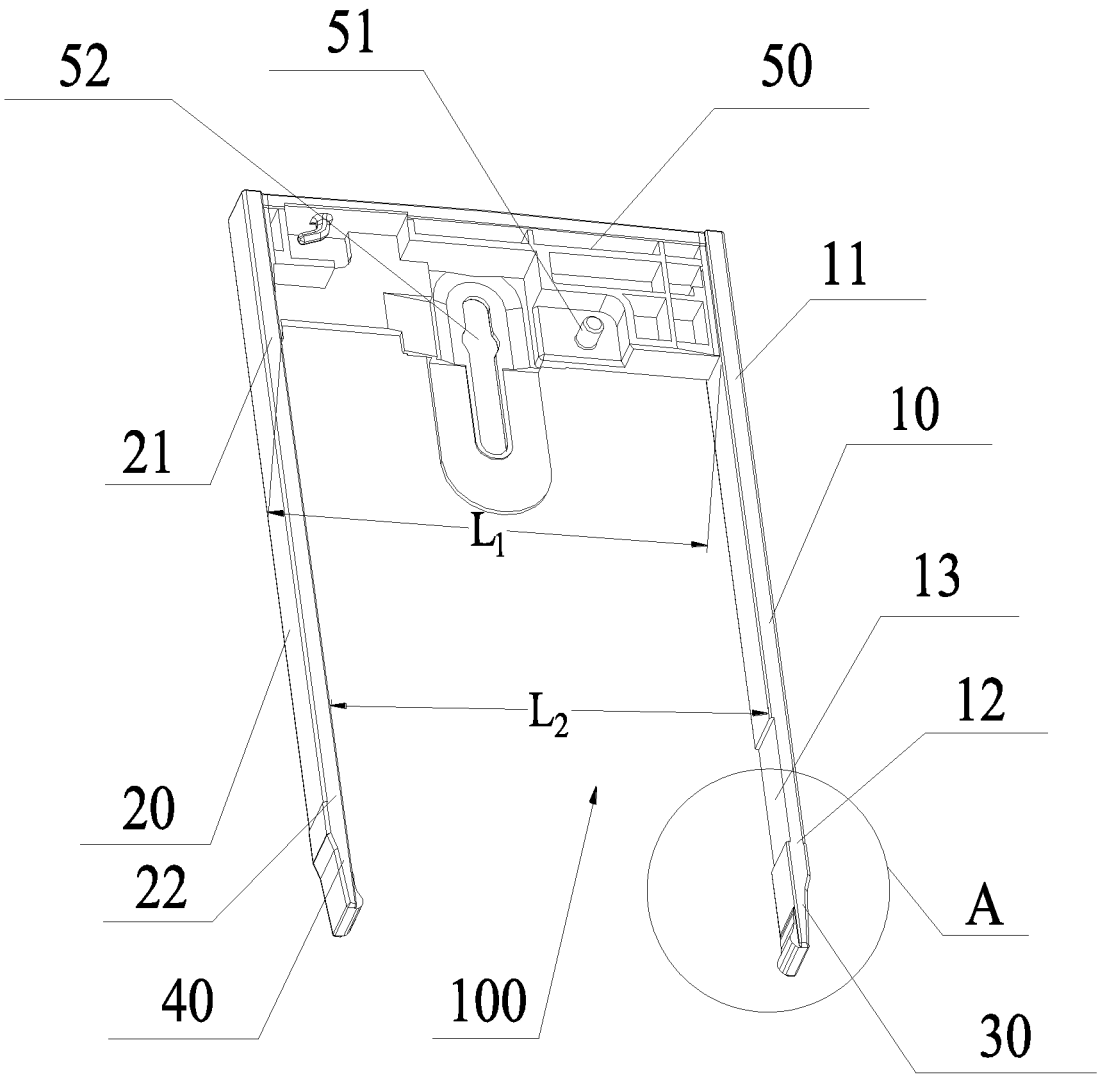
FIG. 1 is a schematic structural diagram of a card fixation assembly according to a first embodiment of the present disclosure.
Figure 2:
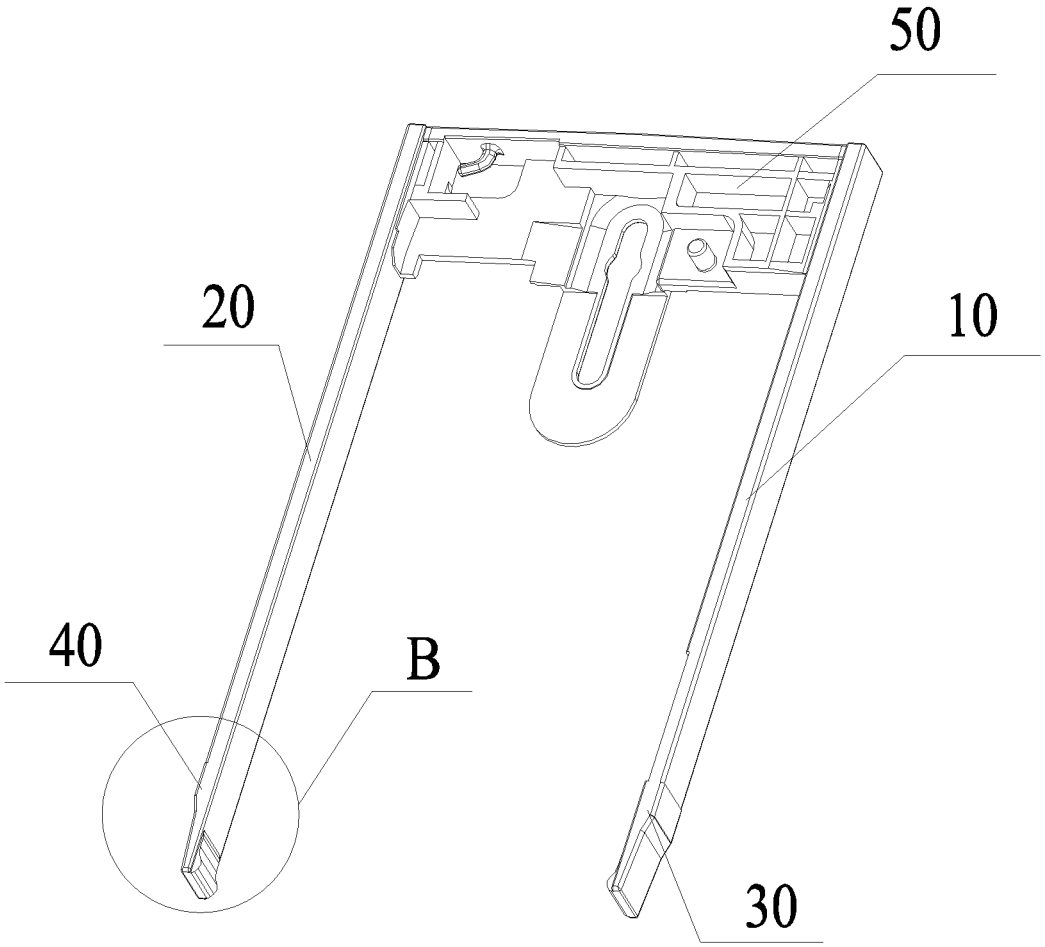
FIG. 2 is a schematic structural diagram of a card fixation assembly from another perspective according to a first embodiment of the present disclosure.

Referring to FIG. 1 and FIG. 2, the first embodiment of the present disclosure provides a card fixation assembly for a card holder. The card fixation assembly 100 includes a first elastic arm 10, a second elastic arm 20, a first clamping end 30, a second clamping end 40, and a main body 50. The first elastic arm start end 11 and the second elastic arm start end 21 are connected to the main body 40; the first elastic arm tail end 12 is connected to the first clamping end 30; and the second elastic arm tail end 22 is connected to the second clamping end 40. The first clamping end 30 and the second clamping end 40 are configured to limit displacement of a card, such that the card is fixed between the first elastic arm 10 and the second elastic arm 20. A distance $L_1$ between the first elastic arm start end 11 and the second elastic arm start end 21 is greater than a distance $L_2$ between the first elastic arm tail end 12 and the second elastic arm tail end 22. When the card is fixed between the first elastic arm 10 and the second elastic arm 20, the first elastic arm 10 and the second elastic arm 20 provide an elastic force for the card to strengthen the fixation of the card. The first elastic arm 10 is further provided with a groove 13, and the groove 13 is configured to place an anti-slip pad. When a width of the card is smaller than $L_1$, the anti-slip pad provides a certain frictional force to help the first clamping end 30 and the second clamping end 40 to fix the card.

Figure 3:
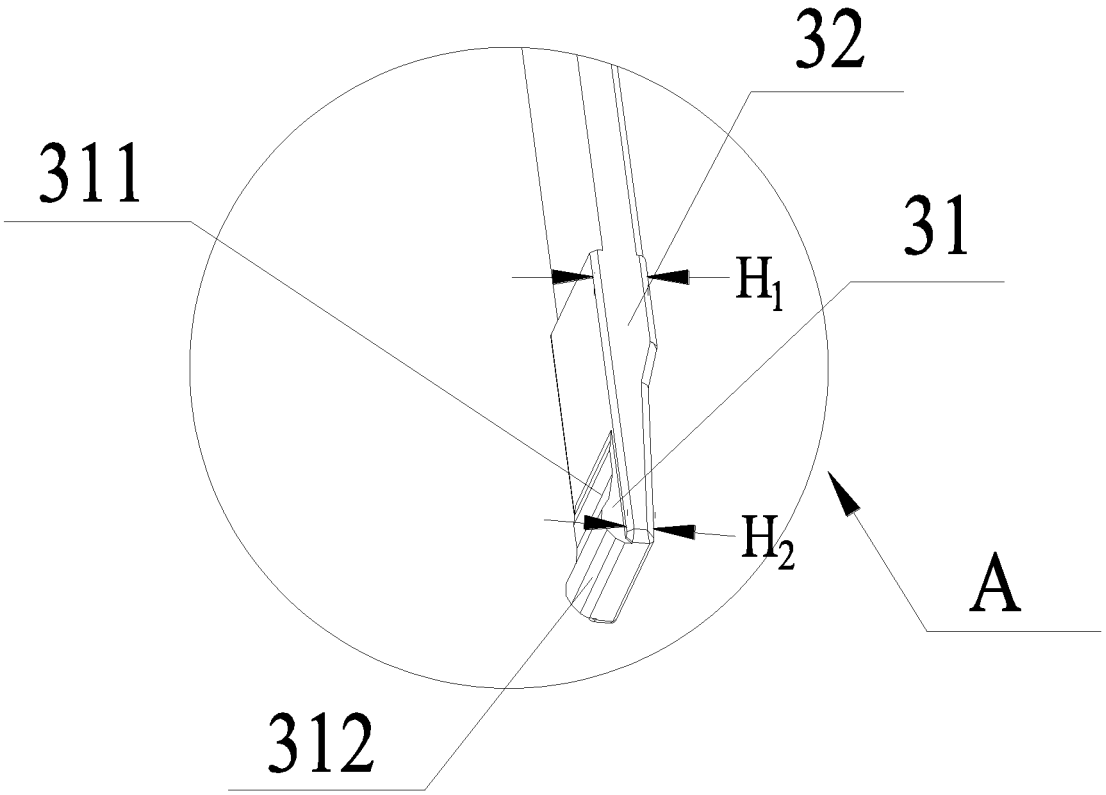
FIG. 3 is an enlarged view of A in FIG. 1.
Figure 4:
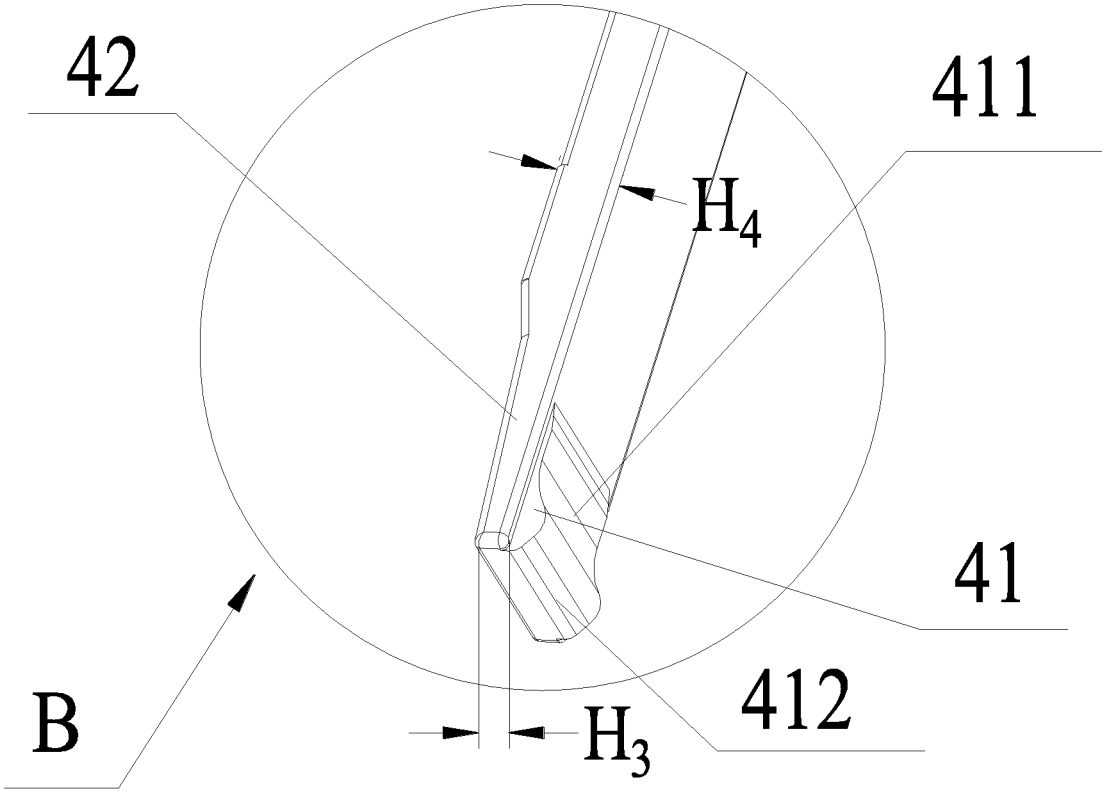
FIG. 4 is an enlarged view of B in FIG. 2.

Referring to FIG. 3 and FIG. 4, the first clamping end 30 includes a first protrusion 31 and a first clamping body 32; and the second clamping end 40 includes a second protrusion 41 and a second clamping body 42. The first protrusion 31 and the second protrusion 41 are configured to limit the displacement of the card. The first clamping body 32 and the first elastic arm 10 are integrally formed, and the second clamping body 42 and the second elastic arm 20 are integrally formed. The first clamping body 32 and the second clamping body 42 are configured to conveniently insert the card fixation assembly 100 into the card holder.

The first protrusion 31 includes a first concave surface 311 and a first convex surface 312. The first concave surface 311 is matched with an arc of the card 201. The first convex surface 312 is a tire-like surface. The first convex surface 312 is adjacent to the first concave surface 311, and is located at a tail end of the first protrusion 31. The second protrusion 41 includes a second concave surface 411 and a second convex surface 412. The second concave surface 411 is matched with an arc of the card 201. The second convex surface 412 is a tire-like surface. The second convex surface 412 is adjacent to the second concave surface 411, and is located at a tail end of the second protrusion 41.

The card is stored into the card fixation assembly 100, and the arc angles of the card abut against the first convex surface 312 and the second convex surface 412. The first convex surface 312 and the second convex surface 412 are tire-like surfaces, and have a small frictional force when being in contact with the card. The card is stored into the card fixation assembly by easily opening the first clamping end 30 and the second clamping end 40. The first concave surface 311 and the second concave surface 411 are matched with the arc angles of the card, and the first elastic arm 10 and the second elastic arm 20 provide an elastic force for the card to fix the card in the card fixation assembly 100 under the action of gravity.

The thickness $H_2$ of a tail end of the first clamping body 32 is smaller than the thickness $H_1$ of a junction between the first clamping body 32 and the first elastic arm 10. The thickness $H_3$ of a tail end of the second clamping body 42 is smaller than the thickness $H_4$ of a junction between the second clamping body 42 and the second elastic arm 20. Therefore, the first clamping body 32 and the second clamping body 42 can be inserted into the card holder more easily, such that the card fixation assembly is inserted into the card holder more conveniently.

The main body 50 includes at least one fixed shaft 51 and at least one notch 52. The fixed shaft 51 and the notch 52 are configured to mount the card pusher. The fixed shaft 51 is configured to provide a fixing point for the card pusher, such that the card pusher forms a lever structure. The notch 52 is configured to provide an extension part for the card pusher, such that a user can push out the card from the card fixation assembly by moving the extension part.

Embodiment 2

Figure 5:
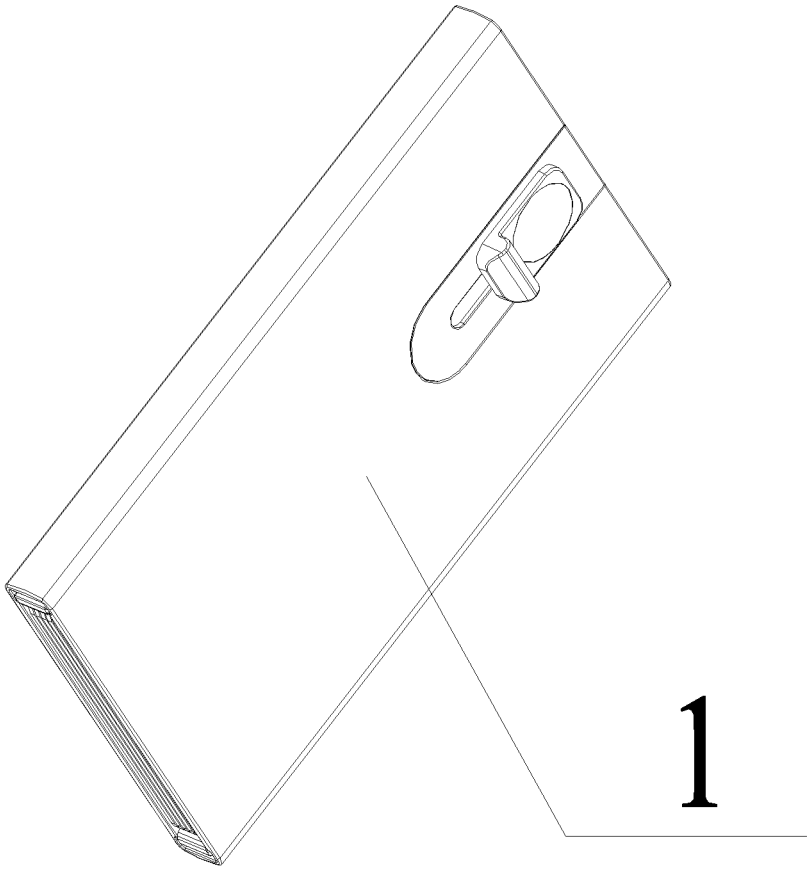
FIG. 5 is a schematic structural diagram of a card holder according to a second embodiment of the present disclosure.
Figure 6:
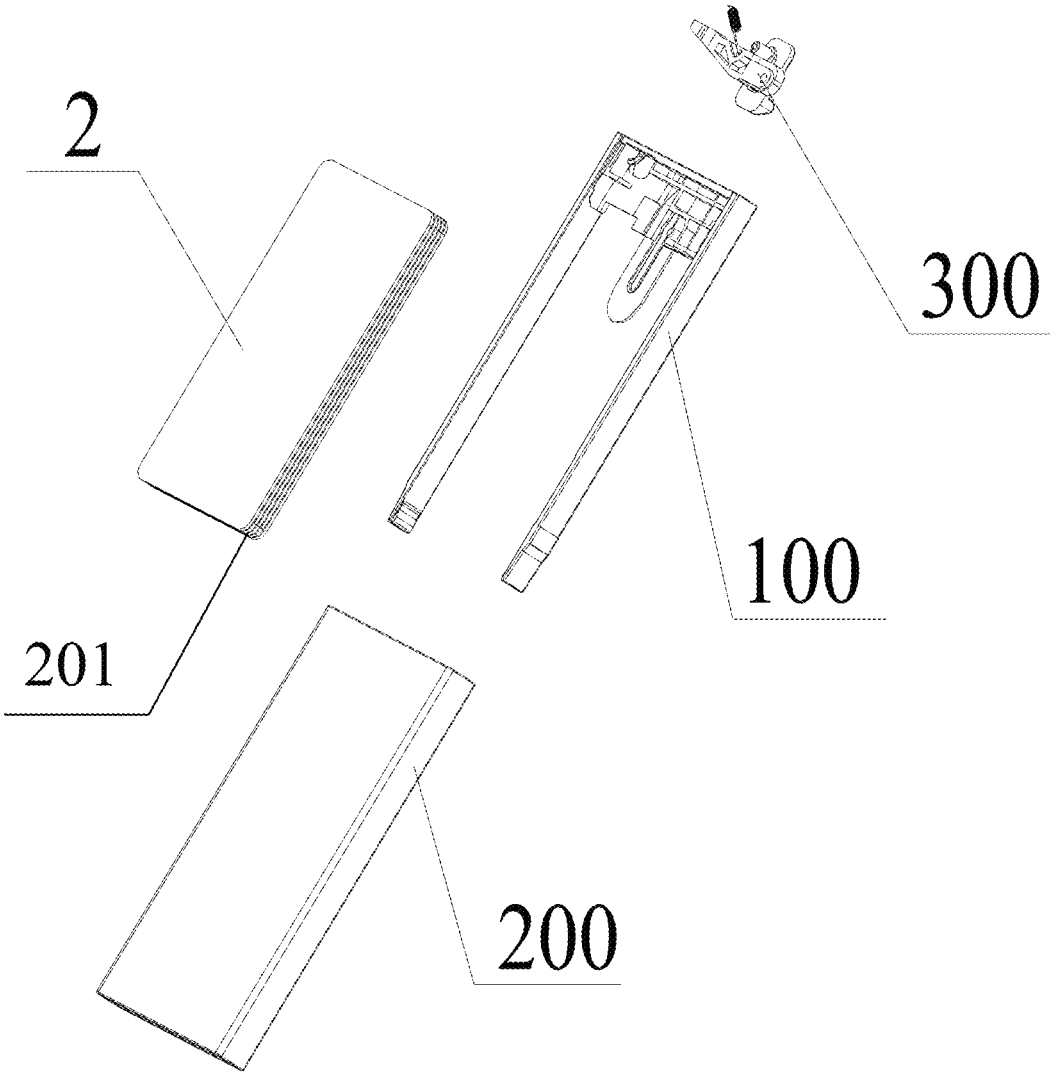
FIG. 6 is an exploded view of a card holder according to a second embodiment of the present disclosure.
Figure 7:
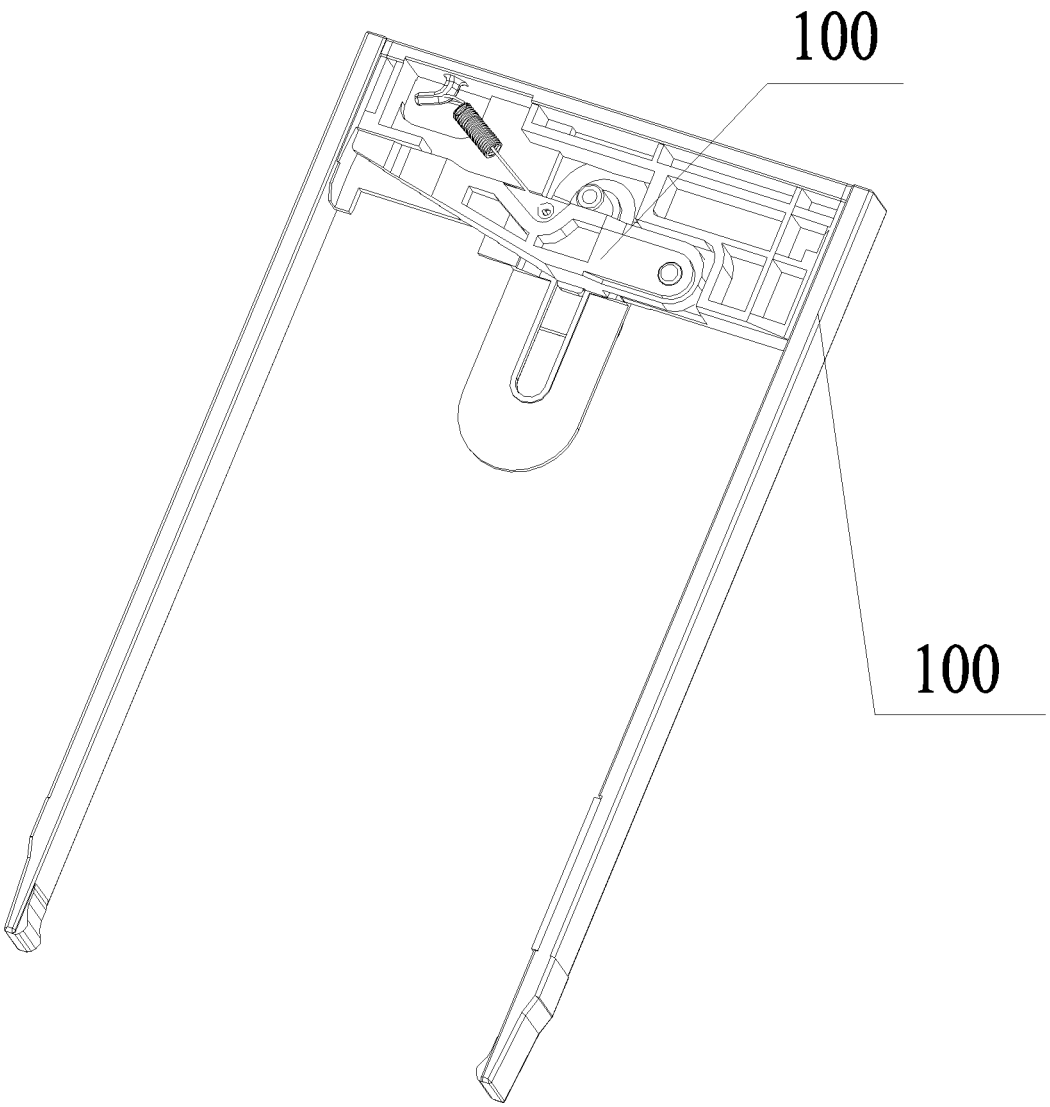
FIG. 7 is a schematic structural diagram of a card fixation assembly and a card pusher in a card holder according to a second embodiment of the present disclosure.

Referring to FIG. 5, FIG. 6, and FIG. 7, the second embodiment of the present disclosure provides a card holder 1. The card holder 1 includes a card fixation assembly 100, a housing 200, and a card pusher 300. The card fixation assembly 100 is the card fixation assembly in Embodiment 1. A card 2 is located in the card fixation assembly 100, the card fixation assembly 100 is mounted in the housing 200, and the card pusher 300 is mounted on a main body 50 of the card fixation assembly. The card fixation assembly 100 is configured to limit displacement of the card 2, the housing 200 is configured to store the card 2, and the card pusher 300 is configured to push out the card.

When the card holder 1 stores the card 2, the card 2 abuts against the first protrusion 31 and the second protrusion 41. The first convex surface 312 and the second convex surface 412 are tire-like surfaces, and have a small frictional force when being in contact with the card 2, such that the first protrusion 31 and the second protrusion 41 are easily open, and the card 2 is stored into the card holder 1.

When the card 2 is taken out from the card holder 1, the card pusher 300 pushes the card 2. The arc angles of the card 2 are matched with the first concave surface 311 and the second concave surface 411, such that the frictional force of the card 2, the first concave surface 311 and the second concave surface 411 is smaller. When the card 2 is pushed out easily, the user takes out the card 2 from the card holder 1.

Embodiment 3

Figure 8:
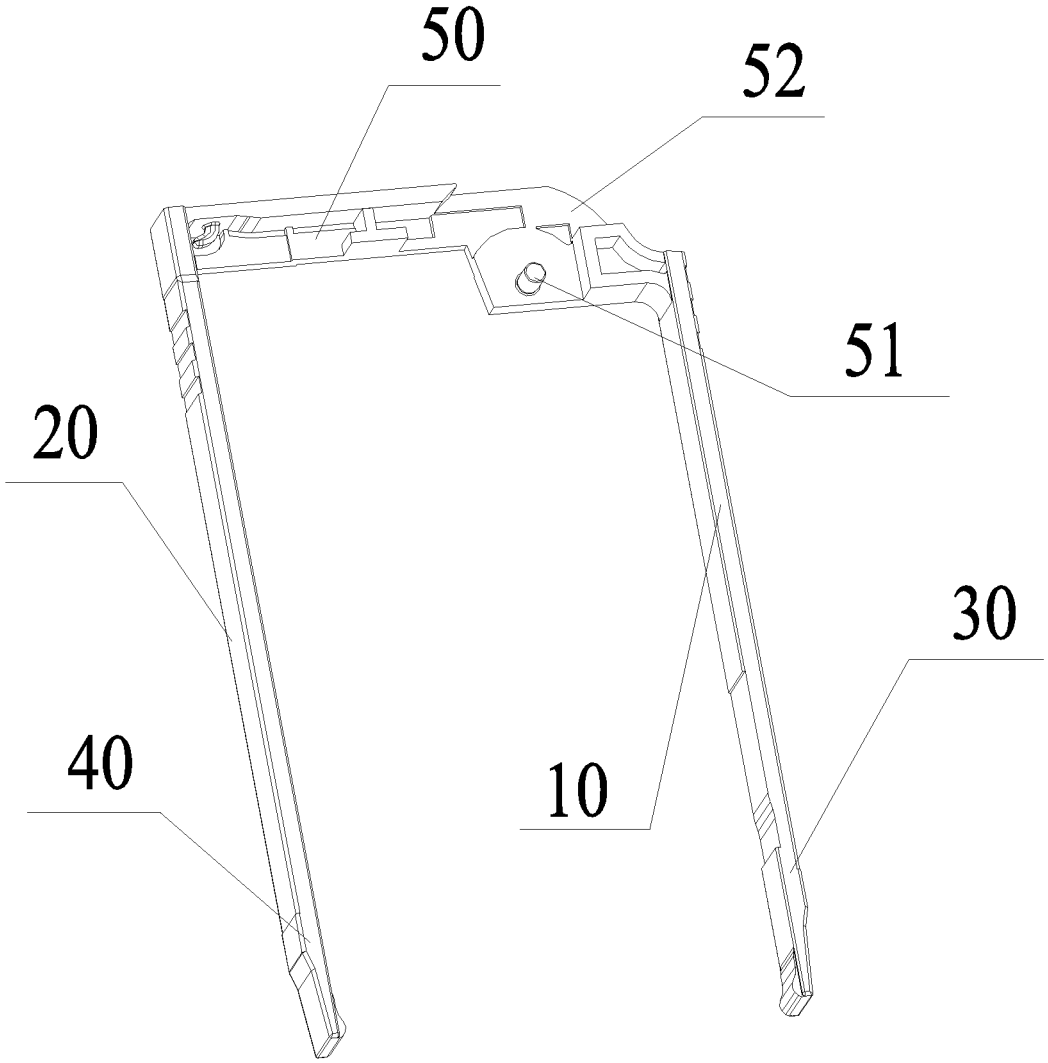
FIG. 8 is a schematic structural diagram of a card fixation assembly according to a third embodiment of the present disclosure.

Referring to FIG. 8, the third embodiment of the present disclosure further provides a novel card fixation assembly for a card holder. The third embodiment differs from the first embodiment in that: the notch 52 in the third embodiment is located at a corner of the main body 50. The extension part of the card pusher 300 is located at a corner of the card holder 1; and in the third embodiment, the user pushes out the card by moving the extension part of the card pusher 300, thereby taking out the card.

Embodiment 4

Figure 9:
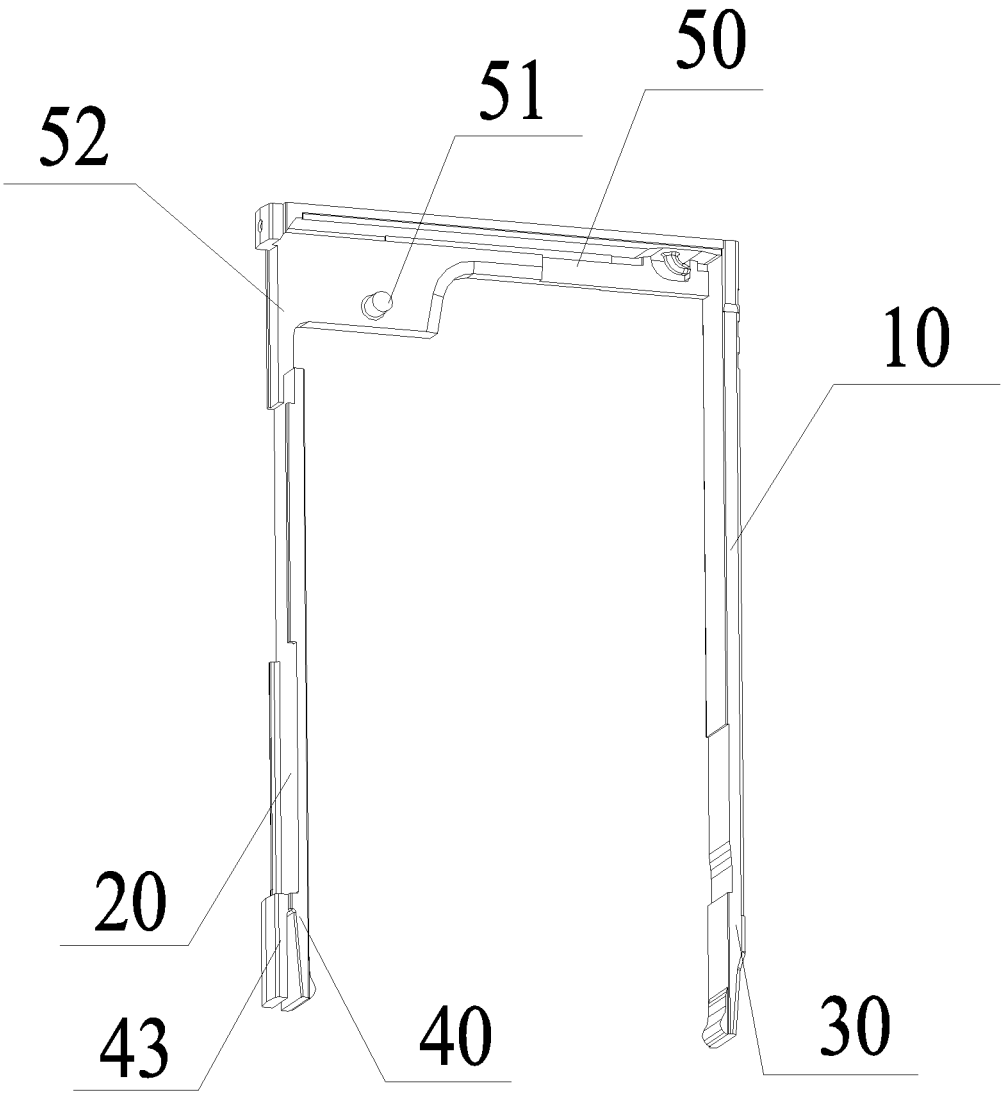
FIG. 9 is a schematic structural diagram of a card fixation assembly according to a fourth embodiment of the present disclosure.

Referring to FIG. 9, the fourth embodiment of the present disclosure further provides a novel card fixation assembly for a card holder. The fourth embodiment differs from the first embodiment in that: the notch 52 in the fourth embodiment is located on a side edge of the main body 50, and the second clamping end 40 further includes a partition 43. The extension part of the card pusher 300 abuts against the partition 43 along the second elastic arm 20. In the third embodiment, the user pushes out the card by moving the extension part of the card pusher 300 located at the partition 43, thereby taking out the card.

Embodiment 5

Figure 10:
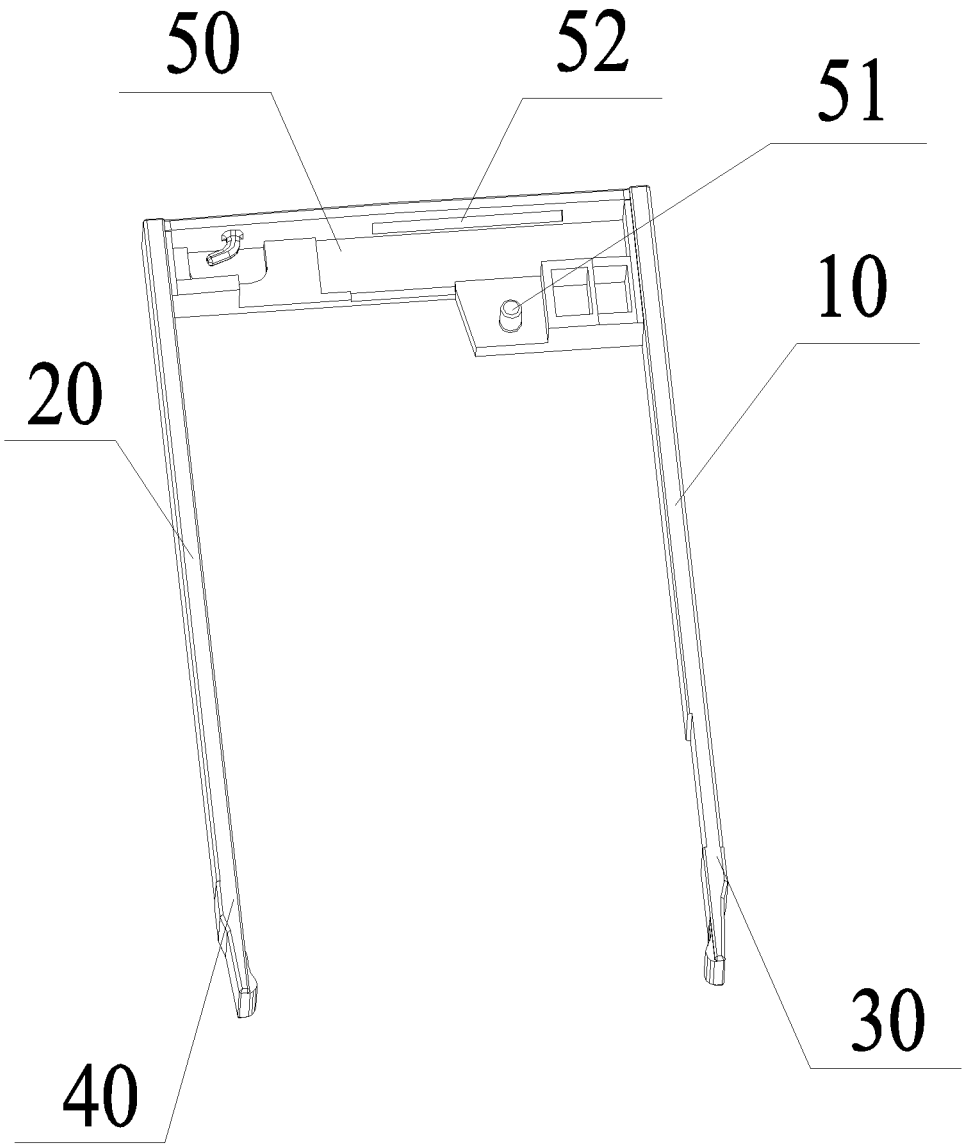
FIG. 10 is a schematic structural diagram of a card fixation assembly according to a fifth embodiment of the present disclosure.

Referring to FIG. 10, the fifth embodiment of the present disclosure further provides a novel card fixation assembly for a card holder. The fifth embodiment differs from the first embodiment in that: the notch 52 in the fifth embodiment is located at a top of the main body 50. The extension part of the card pusher 300 is located at a top of the card holder 1; and in the fifth embodiment, the user pushes out the card by moving the extension part of the card pusher 300, thereby taking out the card.

The above disclosed is only a preferred embodiment of the present disclosure, and definitely should not be used to limit the scope of the claims of the present disclosure. Those of ordinary skill in the art can understand all or some of the procedures for implementing the foregoing embodiments and make equivalent changes according to the claims of the present disclosure. The equivalent changes still fall within the scope of the present disclosure.

What is claimed is:

1. A card fixation assembly for a card holder, comprising: a main body, a first elastic arm, a second elastic arm, a first clamping end, and a second clamping end, wherein a first elastic arm start end and a second elastic arm start end are connected to the main body; a first elastic arm tail end is connected to the first clamping end; a second elastic arm tail end is connected to the second clamping end;

the first clamping end comprises a first protrusion; the second clamping end comprises a second protrusion; the first protrusion and the second protrusion are configured to limit displacement of a card; the first protrusion comprises a first concave surface and a first convex surface; the first concave surface is matched with an arc of the card; the first convex surface is adjacent to the first concave surface, and is located at a tail end of the first protrusion; the second protrusion comprises a second concave surface and a second convex surface; the second concave surface is matched with the arc of the card; and the second convex surface is adjacent to the second concave surface, and is located at a tail end of the second protrusion.

2. The card fixation assembly according to claim 1, wherein the first clamping end further comprises a first clamping body; the first clamping body and the first elastic arm are integrally formed; and a tail end of the first clamping body is thinner than a junction between the first clamping body and the first elastic arm.

3. The card fixation assembly according to claim 1, wherein the second clamping end further comprises a second clamping body; the second clamping body and the second elastic arm are integrally formed; and a tail end of the second clamping body is thinner than a junction between the second clamping body and the second elastic arm.

4. The card fixation assembly according to claim 1, wherein at least one of the first elastic arm and the second elastic arm is provided with a groove, and the groove is configured to place an anti-slip pad.

5. The card fixation assembly according to claim 1, wherein a distance between the first elastic arm start end and the second elastic arm start end is greater than a distance between the first elastic arm tail end and the second elastic arm tail end.

6. The card fixation assembly according to claim 1, wherein the first elastic arm, the second elastic arm, and the main body are integrally formed.

7. The card fixation assembly according to claim 1, wherein the main body comprises at least one fixed shaft.

8. The card fixation assembly according to claim 1, wherein the main body further comprises at least one notch.

9. A card holder, comprising: a housing, a card pusher, and the card fixation assembly according to claim 1, wherein the card fixation assembly is mounted in the housing, and the card pusher is mounted on the main body of the card fixation assembly.

* * * * *